United States Patent [19]

Tsuchiya et al.

[11] 4,432,711

[45] Feb. 21, 1984

[54] VANE PUMP WITH CYLINDER PROFILE DEFINED BY CYCLOID CURVES

[75] Inventors: Keiji Tsuchiya; Hideaki Sasaya; Akio Nara, all of Okazaki, Japan

[73] Assignee: Nippon Soken, Inc., Nishio, Japan

[21] Appl. No.: 317,407

[22] Filed: Nov. 2, 1981

[30] Foreign Application Priority Data

Nov. 7, 1980 [JP] Japan ..... 55-157403
Jun. 10, 1981 [JP] Japan ..... 56-88012

[51] Int. Cl.[3] ..... F04C 2/00
[52] U.S. Cl. ..... 418/150; 418/255
[58] Field of Search ..... 418/150, 254, 255

[56] References Cited

U.S. PATENT DOCUMENTS 1,006,035 10/1911 West ..... 418/255
1,977,780 10/1934 Stageberg ..... 418/255
2,247,410 7/1941 Ross ..... 418/255
2,452,471 10/1948 Jones ..... 418/255
3,642,390 2/1972 Ostberg ..... 418/150

FOREIGN PATENT DOCUMENTS 733731 7/1932 France ..... 418/255
607833 9/1960 Italy ..... 418/255

*Primary Examiner*—John J. Vrablik
*Attorney, Agent, or Firm*—Cushman, Darby & Cushman

[57] ABSTRACT

A vane pump comprising a cylindrical rotor provided with a diametrically extending vane groove, a vane slidably arranged in the vane groove in radial directions, a cylinder in which the rotor is rotatably arranged, the cylinder having an inner peripheral cam surface with which said vane always comes into sliding contact at its opposed ends, the cam surface of the cylinder having a profile defined by cycloid curves and/or arc portions which have a radius substantially equal to that of the rotor.

6 Claims, 7 Drawing Figures

VANE PUMP WITH CYLINDER PROFILE DEFINED BY CYCLOID CURVES

This invention relates to a vane pump, and particularly to an oil hydraulic vane pump which can be used, for example, as a hydraulic device, such as a power steering apparatus in a motor car.

As an oil hydraulic pump for an automobile power steering there is conventionally used a vane pump or a slipper pump. The vane pump has a cylindrical rotor which is provided with a plurality of radial grooves in which vanes are arranged. The rotor rotates in a cam ring to produce an oil hydraulic pressure. On the other hand, the slipper pump has a cylinder which is provided with a plurality of radial grooves in which slippers are arranged, and a cam rotor which is eccentric to the cylinder and which rotates while keeping in sliding contact with the slippers to produce hydraulic pressure.

However, in these types of known pumps, a large number of vanes or slippers and of associated radial grooves for receiving the vanes or slippers is necessary, and, in addition thereto, the pumpability largely depends on the dimensional precision of these elements. Therefore, in order to increase the pumpability, it is necessary to increase the dimensional precision of the vanes or slippers and the associated grooves, which results in an increase of the manufacturing cost and the manufacturing time and which results also in a complicated assembly of the same.

The primary object of the present invention is, therefore, to decrease the number of components of a vane pump, so that it includes only one or two vanes which ensure(s) a large flow rate.

The secondary object of the present invention is to make the small bearings of a pump shaft connected to a cylindrical rotor, in which a radial load due to an upbalance in the hydraulic pressure acting on the cylindrical rotor as well as a radial load due to tension in the belt which transmits a drive to the pump shaft are both supported by the inner peripheral seal surface of a cylinder.

Another object of the present invention is to provide a vane pump in which the area of the inner peripheral seal surface of the cylinder is large enough to increase the volumetric efficiency of the pump.

The invention will become more apparent from the detailed description of the preferred embodiments presented below, with reference being made to the accompanying drawings, in which.

Figure 1:
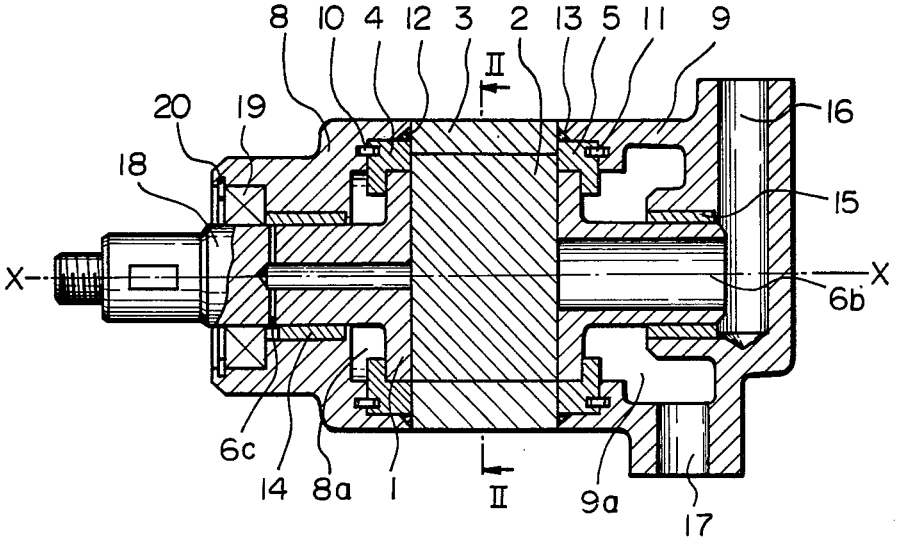
FIG. 1 is a longitudinal sectional view of a vane pump according to an embodiment of the present invention.

A cylindrical rotor 1 which is integral with a drive shaft 18 connected to a drive (not shown) has a diametrically extending vane groove 1*a* in which a vane 2 is slidably arranged and suction ports 6*a* and discharge ports 7. The suction ports 6*a* and the discharge ports 7 are located on both sides of the vane groove 1*a* and open on the outer periphery of the rotor 1. The rotor 1 and the vane 2 are arranged in a cylinder 3. The rotor 1, the vane 2 and the cylinder 3 are covered at their front and rear ends, by a front end plate 4 and a rear end plate 5. The end plates 4 and 5 are secured to a front housing 8 and a rear housing 9, respectively which are integral with or rigidly connected to the cylinder 3. Pins 10 and 11 prevent the end plates 4 and 5 from rotating, respectively. The rotor 1 rotates in the cylinder 3 about its center axis X—X.

The drive shaft 18 has a center bore, i.e. a suction passage 6*b* which is connected to a suction port 16 of the rear housing 9 and which is connected also to the suction ports 6*a* of the rotor 1. The drive shaft 18 also has lubricant oil passages 6*c* connected to the suction passage 6*b*. The drive shaft 18 is rotatably supported by bearings 14 and 15 which are mounted on to the front and rear housings 8 and 9, respectively. On both sides of the rotor 1 and in the front and rear housings 8 and 9 there are provided discharge chambers 8*a* and 9*a* which are connected to the discharge ports 7 of the rotor 1 to maintain the thrust balance of the rotor 1. The discharge chamber 9*a* is connected to a discharge port 17 formed in the rear housing 9. Between the cylinder 3 and the housings 8, 9 are provided O-rings 12 and 13 to ensure a seal effect therebetween. The numeral 19 designates an oil seal which prevents the working fluid from leaking along and onto the drive shaft 18 and the numeral 20 designates a clip for securing the oil seal 19 on the shaft 18.

The cylinder 3 has an inner periphery 3*a* which serves as a cam surface having a profile so that the cam surface comes into surface contact with the outer cylindrical periphery of the rotor 1 at three points $P_1$, $P_2$ and $P_3$ which are peripherally spaced from one another at a equiangular distance of 120° (i.e., with a phase difference of $\frac{2}{3}\pi$), and the distance L between any diametrically opposed two points (i.e. with a phase difference of $\pi$) on the cam surface is always equal to the length of the vane 2.

Figure 3:
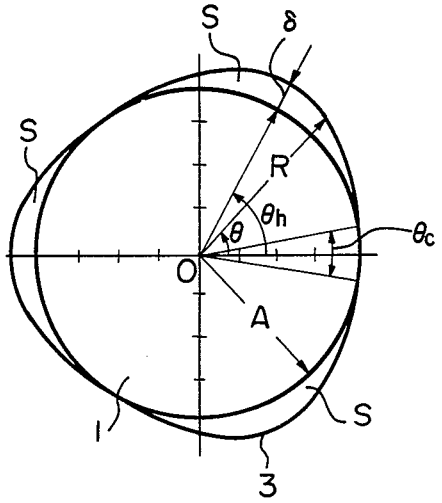
FIG. 3 shows a polar coordinate showing the relationship between an inner peripheral surface of a cylinder and an outer periphery of a rotor, according to the present invention.
Figure 4:
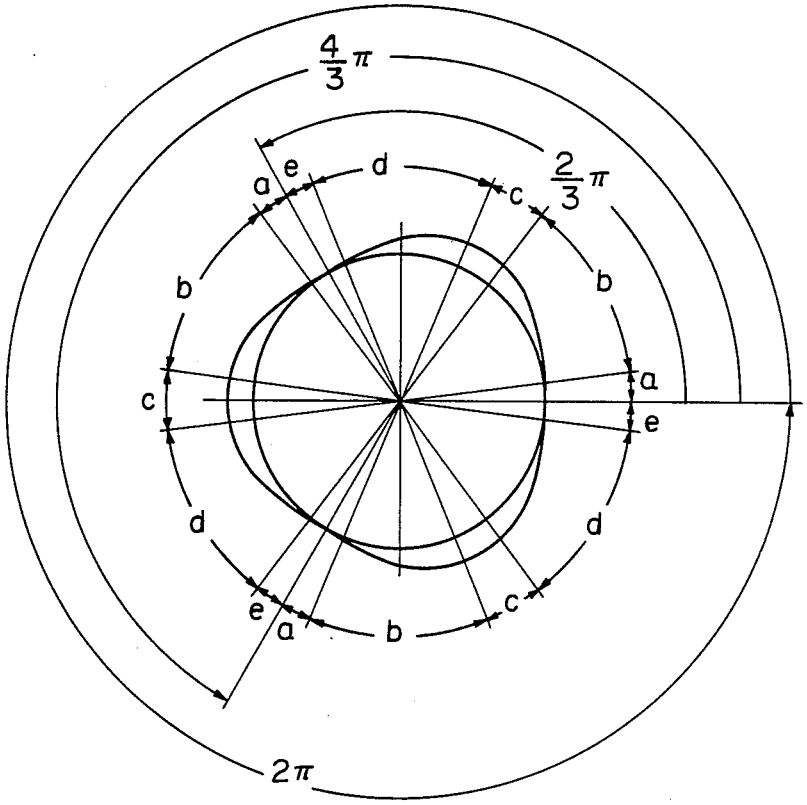
FIG. 4 shows a profile of an inner peripheral surface of the cylinder shown in FIGS. 2 and 3.

FIGS. 3 and 4 show a relationship between the cam surface 3*a* of the cylinder 3 and the outer periphery of the cylindrical rotor 1, on a polar coordinate, in which:

R; a radius vector, i.e. the distance between the center O of the rotor 1 and the cam surface 3*a*

A; the radius of the rotor 1

$\theta$; a phase [rad.] of the vector R from one of three contact points of the cam surface 3*a* with the rotor 1

$\delta$; the maximum radial displacement (lift) of the vane 2

$\theta_h$; a phase [rad.] of the vector R at the maximum radial displacement of the vane 2.

$\theta_h$ is $\pi/3$ [rad.] in FIG. 3.

The rotor 1 and the cam surface 3*a* are brought into surface contact with each other at phase of angle $\theta_c$ which is, for example, $\pi/12$ in FIG. 3.

Now, the profile of the cam surface 3*a* is such that it is represented as follows.

1. $0 \leqq \theta < \frac{\pi}{24}$ (first section *a*)

-continued $$R = A$$

2. $\frac{\pi}{24} \leqq \theta < \frac{7}{24}\pi$ (second section *b*)

$$R = A + \delta \cdot \left( \frac{4\theta'}{\pi} - \frac{1}{2\pi} \sin 8\theta' \right)$$

wherein $\theta' = \theta - \frac{\pi}{24}$

3. $\frac{7}{24}\pi \leqq \theta < \frac{9}{24}\pi$ (third section *c*)

$$R = A + \delta$$

4. $\frac{9}{24}\pi \leqq \theta < \frac{15}{24}\pi$ (fourth section *d*)

$$R = A + \delta - \delta \cdot \left( \frac{4\theta'}{\pi} - \frac{1}{2\pi} \sin 8\theta' \right)$$

wherein $\theta' = \theta - \frac{9}{24}\pi$

5. $\frac{15}{24}\pi \leqq \theta < \frac{2}{3}\pi$ (fifth section *e*)

$$R = A$$

Since the profile of the cam surface 3*a* consists of three identical surface portions which have a phase difference of $\frac{2}{3}\pi$ therebetween, the radius vector R varies also in the two remaining areas represented by $$\frac{2}{3}\pi \leqq \theta < \frac{4}{3}\pi \text{ and } \frac{4}{3}\pi \leqq \theta < 2\pi,$$

similar to the above mentioned area $0 \leqq \theta < \frac{2}{3}\pi$.

Figure 5:
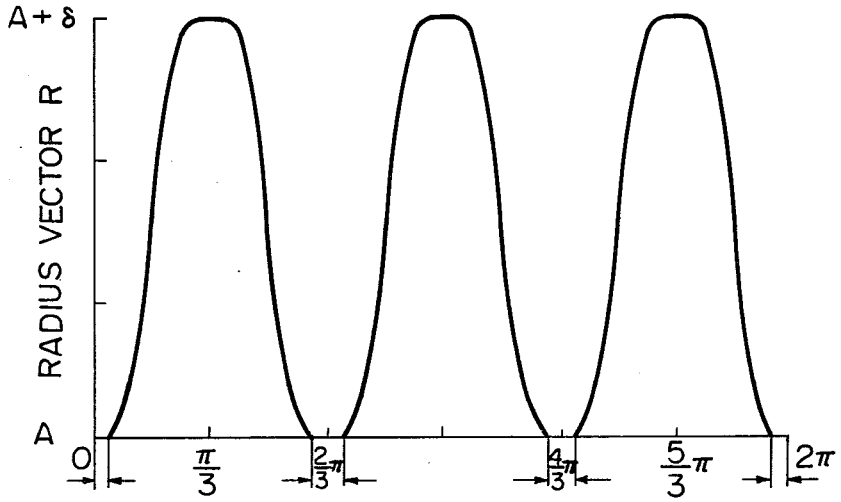
FIG. 5 is a diagram showing the displacement of a radius vector of the cam surface of a cylinder.

Therefore, the cam profile of the inner periphery 3*a* of the cylinder 3 in an illustrated embodiment consists of an arc and a cycloid curve which is represented by the equation $$R = A_0 + d\max \cdot \left( \frac{\theta}{\theta_h} - \frac{1}{2\pi} \sin \frac{2\pi}{\theta_h} \theta \right)$$

wherein $A_0$=a reference length, $\theta_h$=the maximum angle displacement of a radius vector R [rad], dmax=-maximum radial length displacement of a radius vector R (See FIG. 5).

The sections b, c and d correspond to pumping chambers S which are defined by the rotor 1, the cylinder 3, and the end plates 4 and 5.

The pump mentioned above operates as follows.

Figure 2:
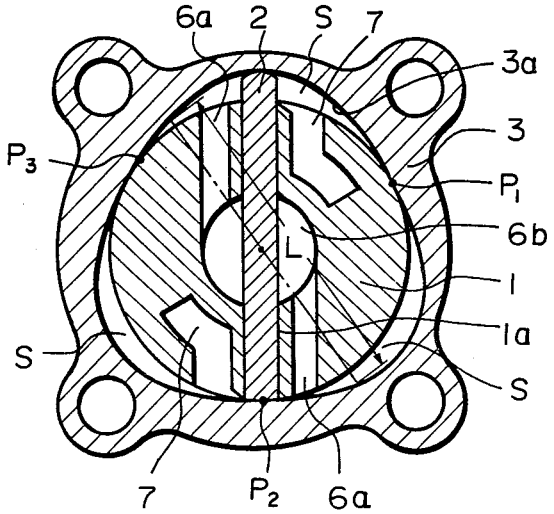
FIG. 2 is a cross sectional view taken along the line II—II in FIG. 1.

When the rotor 1 rotates in a clockwise direction in FIG. 2, while keeping a slide contact of both ends of the vane 2 with the cam surface 3*a* of the cylinder 3, the volume of the chamber or the part of chamber that is located in front of the vane 2, when viewed in the direction of the rotation of the vane, is decreased by the movement of the vane, so that the oil in the chamber of decreased volume is discharged into the discharge chambers 8*a*, 9*a* from the discharge ports 7. On the other hand, the volume of the chamber or the part of the chamber that is located in the rear of the vane 2, when viewed in the direction of the rotational movement of the vane, is increased and accordingly, the oil is introduced into the chamber through the suction ports 6*a*.

It should be noted that in an actual design of a vane pump, there is usually provided a slight clearance of several tens μm between the rotor 1 and the inner surface 30*a* of the cylinder even at the first or fifth section a or e of the profile of the inner surface 3*a* to enable the rotor to be free to rotate. However, the amount of oil leaking from the clearance is negligibly small, since the rotor and the cylinder come into surface contact with each other.

In the illustrated embodiment, since the rotor 1 comes into surface contact with the inner surface 3*a* of the cylinder 3 at three points $P_1$, $P_2$ and $P_3$, the radial load which acts on the rotor 1 can be effectively supported by these surface contact portions.

Figure 6:
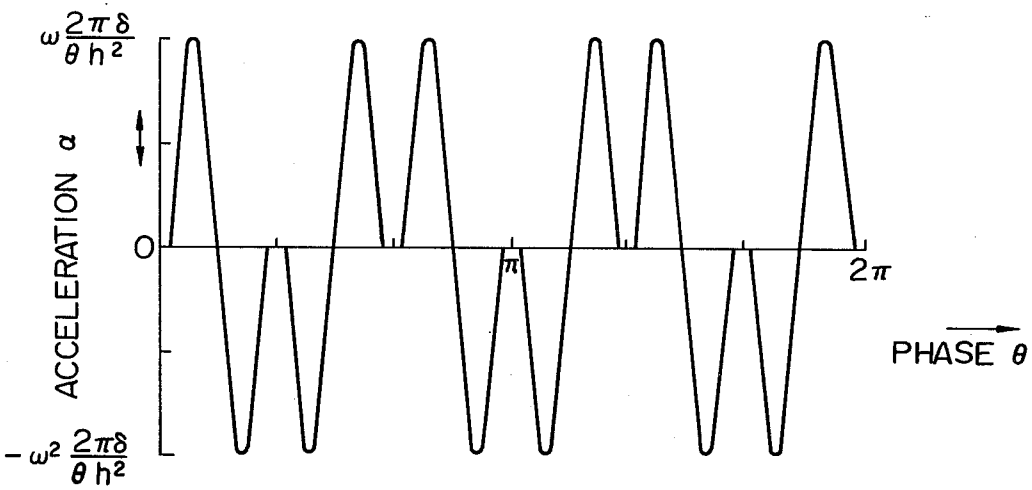
FIG. 6 is a diagram showing the acceleration of a vane, in the present invention; and, FIG. 7 is a diagram showing the volumetric efficiency of a vane pump according to the present invention, in comparison with a prior art.

FIG. 6 shows a diagram of acceleration α of the vane 2 in one rotation when the rotor 1 rotates at an angular velocity of Ω rad/sec. As can be seen from FIG. 6, the acceleration diagram has no discontinuity point, and, accordingly, oscillation and noise of the pump can be decreased.

The number of the surface contact portions of the rotor 1 with the cam surface 3*a* is not limited to three, but can be more than three. However, the number must be always an odd number, since the vane 2 always comes into contact with the cam surface 3*a*, at both ends of the vane 2. Furthermore, as the number of the surface contact portions increases, the volume of the pumping chambers S decreases accordingly, and the number is preferably not more than nine. That is, the number is preferably three, five, seven or nine.

Furthermore, the number of the vane 2 is not limited to one, but a plurality of vanes 2 can be provided.

In another embodiment of the present invention, the profile of the cam surface 3*a* is such that:

1. $0 \leqq \theta \leqq \frac{\pi}{3}$ $$R = A + \delta \cdot \left( \frac{\theta}{\theta_h} - \frac{1}{2} \sin \frac{2\pi}{\theta_h} \theta \right)$$

2. $\frac{\pi}{3} \leqq \theta \leqq \frac{2}{3}\pi$ $$R = A + \delta - \delta \cdot \left( \frac{\theta'}{\theta_h} - \frac{1}{2\pi} \sin \frac{2\pi}{\theta_h} \theta' \right)$$

wherein $\theta' = \theta - \frac{\pi}{3}$

3. $\frac{2}{3}\pi \leqq \theta \leqq \pi$ $$R = A + \delta \cdot \left( \frac{\theta'}{\theta_h} - \frac{1}{2\pi} \sin \frac{2\pi}{\theta_h} \theta' \right)$$

wherein $\theta' = \theta - \frac{2}{3}\pi$

4. $\pi \leqq \theta \leqq \frac{4}{3}\pi$ $$R = A + \delta - \delta \cdot \left( \frac{\theta'}{\theta_h} - \frac{1}{2\pi} \sin \frac{2\pi}{\theta_h} \theta' \right)$$

wherein $\theta' = \theta - \pi$

-continued

5. $\frac{4}{3}\pi \leqq \theta \leqq \frac{5}{3}\pi$ $$R = A + \delta \cdot \left( \frac{\theta'}{\theta_h} - \frac{1}{2\pi} \sin \frac{2\pi}{\theta_h} \theta' \right)$$

wherein $\theta' = \theta - \frac{4}{3}\pi$

6. $\frac{5}{3}\pi \leqq \theta \leqq 2\pi$ $$R = A + \delta - \delta \cdot \left( \frac{\theta'}{\theta_h} - \frac{1}{2\pi} \sin \frac{2\pi}{\theta_h} \theta' \right)$$

wherein $\theta' = \theta - \frac{5}{3}\pi$

That is, the cam surface 3*a* consists of six cycloid curves each having a phase of $\pi/3$.

As mentioned above, there is a slight clearance between the outer periphery of the rotor 1 and the inner periphery 3*a* of the cylinder 3 to enable the rotor to smoothly rotate in the cylinder. In the second embodiment, strictly speaking, no surface contact occurs between the rotor and the cylinder, since no arc profile portion, such as the section a or e in the first embodiment is provided. Accordingly, there is a possibility that oil may leak from the clearance. However, the possibility is negligible also in the second embodiment due to the presence of the cycloid curve profile.

In a conventional vane pump, the cylinder usually has an inner surface of a profile mainly defined by a sine curve which is generally represented by the following equation, $$R = A + \frac{\delta}{2} + \frac{\delta}{2} \sin \left( 3\theta - \frac{\pi}{2} \right)$$

In comparison with such a sine curve profile, the cycloid curve profile as in the present invention, presents a smaller value of differential $dR/d\theta$ of the radius vector R in the vicinity of the contact portions $$\left( \theta = 0, \frac{2}{3}\pi, \frac{4}{3}\pi \text{ [rad.]} \right)$$

between the rotor 1 and the cylinder. Accordingly, it can be considered that the cycloid curve profile substantially provides not a line contact (line seal) but a surface contact (surface seal) with the rotor. Therefore, oil leakage from the clearance can be decreased.

The change of the radius vector R in the vicinity of the slide contact portions at A=25 mm and $\delta$=4 mm is shown in table 1, in comparison with the sine curve profile.

TABLE 1

| PHASE | RADIUS VECTOR R [mm] | |
|---|---|---|
| $\theta$ deg | cycloid | sine curve |
| 0 | 25 | 25 |
| 1 | 25.000 | 25.003 |
| 2 | 25.001 | 25.011 |
| 3 | 25.003 | 25.025 |
| 4 | 25.008 | 25.044 |

TABLE 1-continued

| PHASE | RADIUS VECTOR R [mm] | |
|---|---|---|
| $\theta$ deg | cycloid | sine curve |
| 5 | 25.015 | 25.068 |

Figure 7:
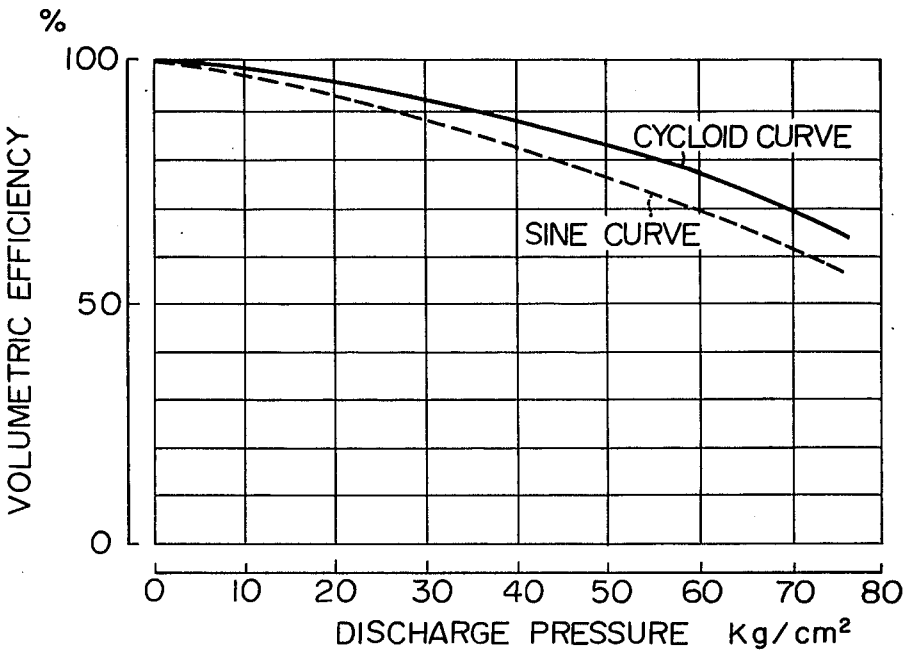

As can be seen from the experimental results shown in table 1, the change of the radius vector R in a cycloid curve is considerably smaller than that of the radius vector in the sine curve, which results in an improvement of the volumetric efficiency of a vane pump, as shown in FIG. 7. FIG. 7 shows experimental results for volumetric efficiency of a vane pump, in which the volumetric efficiency of the present invention, (cycloid profile), as designated by a solid line is superior to that of a prior art (sine curve profile) as designated by a dotted line. In the experiments shown in FIG. 7, the theoretical volume of pumping chambers was 10 cc/rev., the coefficient of kinematic viscosity of the oil used was 11 cst., the clearance between the rotor and the cylinder at the slide contacting portions was 25 $\mu$m., and the number of revolutions of the rotor was 750 rpm.

Furthermore, with respect to a profile consisting of cycloid curves continuously connected to each other, since the differential $dR/d\theta$ and the second differential $d^2R/d\theta^2$ at the connecting points $$\left( \theta = \frac{\pi}{3}\pi, \frac{2}{3}\pi, \pi, \frac{4}{3}\pi, \frac{5}{3}\pi, 2\pi \right)$$

are both equal to zero $$\left( \frac{dR}{d\theta} = 0, \frac{d^2R}{d\theta^2} = 0 \right),$$

a smooth movement of the rotor 1 following the inner surface 3*a* of the cylinder 3 can be ensured. Furthermore, it is also possible to put arc portions which have a radius equal to or approximately equal to that of the cylindrical rotor 1, between the two adjacent cycloid curves in the vicinity of the slide contact portions similar to the first embodiment, in order to further decrease the amount of leakage of the oil.

As can be understood from the above discussion, according to the present invention, there can be provided a vane pump which has only one vane or two or small number of vanes and which presents a high pumpability. The decrease in the number of vanes makes it possible to easily assemble the pump at a low cost.

Furthermore, according to the present invention, the cam surface, i.e. the inner peripheral surface of the cylinder has a cycloid profile, the amount of leakage of working fluid from the clearance between the rotor and the cylinder can be decreased, and, accordingly, the volumetric efficiency can be increased.

In addition, by the provision of arc portions having a radius identical to or approximately identical to that of the cylindrical rotor, on a cycloid profile of the cam surface of the cylinder, at the slide contact portions between the rotor and the cylinder, the area of the seal surface at the slide contact portions can be increased, so that the amount of the leakage of the working fluid at the slide contact portions can be decreased, which results in an increase in the volumetric efficiency of the pump.

We claim:

1. A vane pump comprising a cylindrical rotor connected to and driven by a drive, said rotor being provided with a diametrically extending vane groove, a vane slidably arranged in said vane groove in radial directions, a cylinder in which said rotor is rotatably arranged about its center axis, said cylinder having an inner peripheral cam surface with which said vane always comes into slide contact at its opposed ends, and a pair of opposed end plates connected to the cylinder to define pumping chambers between the rotor and the cylinder, said cam surface of the cylinder having a profile defined by cycloid curves wherein said cam surface of the cylinder has a profile consisting of continuously connected cycloid curves which are represented by the following equations:

$$0 \leqq \theta \leqq \frac{\pi}{3}$$

$$R = A + \delta \cdot \left( \frac{\theta}{\theta_h} - \frac{1}{2\pi} \sin \frac{2\pi}{\theta_h} \theta \right)$$

$$\frac{\pi}{3} \leqq \theta \leqq \frac{2\pi}{3}$$

$$R = A + \delta - \delta \cdot \left( \frac{\theta'}{\theta_h} - \frac{1}{2\pi} \sin \frac{2\pi}{\theta_h} \theta' \right)$$

wherein $\theta' = \theta - \frac{\pi}{3}$ $$\frac{2}{3}\pi \leqq \theta \leqq \pi$$

$$R = A + \delta \cdot \left( \frac{\theta'}{\theta_h} - \frac{1}{2\pi} \sin \frac{2\pi}{\theta_h} \theta' \right)$$

wherein $\theta' = \theta - \frac{2}{3}\pi$ $$\pi \leqq \theta \leqq \frac{4}{3}\pi$$

$$R = A + \delta - \delta \cdot \left( \frac{\theta'}{\theta_h} - \frac{1}{2\pi} \sin \frac{2\pi}{\theta_h} \theta' \right)$$

wherein $\theta' = \theta - \pi$ $$\frac{4}{3}\pi \leqq \theta \leqq \frac{5}{3}\pi$$

$$R = A + \delta \cdot \left( \frac{\theta'}{\theta_h} - \frac{1}{2\pi} \sin \frac{2\pi}{\theta_h} \theta' \right)$$

wherein $\theta' = \theta - \frac{4}{3}\pi$ $$\frac{5}{3}\pi \leqq \theta \leqq 2\pi$$

$$R = A + \delta - \delta \cdot \left( \frac{\theta'}{\theta_h} - \frac{1}{2\pi} \sin \frac{2\pi}{\theta_h} \theta' \right)$$

wherein $\theta' = \theta - \frac{5}{3}\pi$ wherein:

R; a radius vector, i.e., the distance between the center axis of the rotor and the cam surface A; the radius of the rotor $\theta$; a phase [rad.] of the vector R $\delta$; the maximum radial displacement (lift) of the vane $\theta_h$; a phase [rad.] of the vector R at the maximum radial displacement of the vane.

2. A vane pump according to claim 1, wherein said rotor always comes into slide contact with the cam surface at an odd number of points.

3. A vane pump according to claim 2, wherein said rotor always comes into slide contact with the cam surface at three points.

4. A vane pump according to claim 3, wherein said profile of the cam surface includes arc portions which have a radius substantially equal to that of the rotor and which are located between the two adjacent cycloid curves at the slide contact portions of the cam surface with the rotor.

5. A vane pump comprising a cylindrical rotor connected to and driven by a drive, said rotor being provided with a diametrically extending vane groove, a vane slidably arranged in said vane groove in radial directions, a cylinder in which said rotor is rotatably arranged about its center axis, said cylinder having an inner peripheral cam surface with which said vane always comes into slide contact at its opposed ends, and a pair of opposed end plates connected to the cylinder to define pumping chambers between the rotor and the cylinder, said cam surface of the cylinder having a profile defined by cycloid curves, wherein said cam surface of the cylinder has a profile defined by three continuously connected identical curves, each consisting of arcs and cycloid curves, the first one third of the curves being represented by the following equations:

$$0 \leqq \theta < \frac{\pi}{24}$$

$$R = A$$

$$\frac{\pi}{24} \leqq \theta < \frac{7}{24}\pi$$

$$R = A + \delta \cdot \left( \frac{4\theta'}{\pi} - \frac{1}{2\pi} \sin 8\theta' \right)$$

wherein $\theta' = \theta - \frac{\pi}{24}$ $$\frac{7}{24}\pi \leqq \theta < \frac{9}{24}\pi$$

$$R = A + \delta$$

$$\frac{9}{24}\pi \leqq \theta < \frac{15}{24}\pi$$

$$R = A + \delta - \delta \cdot \left( \frac{4\theta'}{\pi} - \frac{1}{2\pi} \sin 8\theta' \right)$$

wherein $\theta' = \theta - \frac{9}{24}\pi$ $$\frac{15}{24}\pi \leqq \theta < \frac{2}{3}\pi$$

$$R = A$$

wherein:

R; a radius vector, i.e. a distance between a center axis of the rotor and the cam surface A; the radius of the rotor $\theta$; a phase [rad.] of the vector R $\delta$; the maximum radial displacement (lift) of the vane $\theta_h$; a phase [rad.] of the vector R at the maximum radial displacement of the vane.

6. A vane pump according to claim 5, wherein said vane always comes into slide contact with the arcs of the profile of the cam surface, represented by R=A.

* * * * *